US007814614B2

(12) United States Patent
Cho et al.

(10) Patent No.: US 7,814,614 B2
(45) Date of Patent: Oct. 19, 2010

(54) SUCTION BRUSH FOR VACUUM CLEANER

(75) Inventors: Jeong-hee Cho, Jeollabuk-do (KR); Tae-gwang Kim, Incheon (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 1089 days.

(21) Appl. No.: 11/510,097

(22) Filed: Aug. 25, 2006

(65) Prior Publication Data

US 2007/0204427 A1 Sep. 6, 2007

(30) Foreign Application Priority Data

Mar. 6, 2006 (KR) ..... 10-2006-0020976

(51) Int. Cl.
*A47L 9/04* (2006.01)

(52) U.S. Cl. ..... 15/383; 15/387; 15/415.1; 15/412

(58) Field of Classification Search ..... 15/383, 15/387, 415.1, 412; *A47L 9/02, 9/04*
See application file for complete search history.

(56) References Cited

U.S. PATENT DOCUMENTS

| | | | | |
|---|---|---|---|---|
| 2,935,343 | A | 5/1960 | Ellis | 285/95 |
| 5,351,362 | A | 10/1994 | Krämer et al. | 15/387 |

FOREIGN PATENT DOCUMENTS

| | | |
|---|---|---|
| DE | 2815196 | 10/1979 |
| DE | 19846890 | 4/2000 |
| EP | 1574159 | 6/2007 |
| FR | 392798 | 12/2008 |
| GB | 739575 | 11/1955 |
| JP | 07-289483 | 7/1995 |

OTHER PUBLICATIONS

Official Action dated Jan. 2, 2007 issued from the Korean Intellectual Property Office with respect to Korean Patent Application No. 2006-20976 filed Mar. 6, 2006.
Office Action dated Oct. 29, 2007 corresponding to Russian Patent Application No. 2006134479.

*Primary Examiner*—David A Redding
(74) *Attorney, Agent, or Firm*—Ohlandt, Greeley, Ruggiero & Perle, LLP

(57) ABSTRACT

The present disclosure relates to a suction brush for a vacuum cleaner, which is connected to a suction extension pipe connected to a main body of the vacuum cleaner and draws in foreign materials using a suction force generated in the main body. The suction brush includes a bottom housing with a dust entering port; a top housing connected to the bottom housing so as to cover the bottom housing; a connector disposed between the top housing and the bottom housing, the connector connected to the suction extension pipe; and a flow rate controller disposed at the connector, the flow rate controller controlling a volume of the air entering through the dust entering port so as to control a suction force.

9 Claims, 5 Drawing Sheets

SUCTION BRUSH FOR VACUUM CLEANER

CROSS-REFERENCE TO RELATED APPLICATIONS

This application claims the benefit under 35 U.S.C. §119(a) from Korean Patent Application No. 2006-20976 filed Mar. 6, 2006 in the Korean Intellectual Property Office, the disclosure of which is incorporated herein by reference in its entirety.

BACKGROUND OF THE INVENTION

1. Field of the Invention

The present disclosure relates to a vacuum cleaner. More particularly, the present disclosure relates to a suction brush for a vacuum cleaner connected to an extension pipe of a vacuum cleaner for cleaning dust on a surface to be cleaned.

2. Description of the Related Art

Generally, a vacuum cleaner has a suction brush for cleaning dust on a surface to be cleaned, where the suction brush is in contact with the surface to be cleaned. The suction brush is connected to an extension pipe, which is connected to a main body of the vacuum cleaner. A suction force, which is generated by a driving motor disposed in the main body of the vacuum cleaner, is applied to the suction brush through the extension pipe. Therefore, while moving along the surface to be cleaned, the suction brush draws in dust from the surface to be cleaned by the applied suction force.

The suction brush, in general, has a bottom housing and a top housing capable of being separated from and coupled with each other via screws. A connector is disposed between the top and bottom housings and is supported by the top and bottom housings. The connector, in general, is detachably connected to an end of the extension pipe.

Furthermore, the suction brush may have a turbine unit, or a brushing unit for brushing a surface to be cleaned thereinside according to its function.

On the other hand, the bottom housing of the suction brush is provided with a dust entering port through which dust on the surface to be cleaned is drawn. The size of the dust entering port determines the strength of the suction force applied to the suction brush. For an example, as the size of the dust entering port is decreased, the suction force is increased, and as the size of the dust entering port is increased, the suction force is decreased.

However, in a conventional suction brush, the size of the dust entering port disposed at the suction brush has been set when manufactured so that users cannot adjust the suction force. Therefore, the users cannot adjust the strength of the suction force applied to the suction brush corresponding to the size of dust, or a kind of surfaces to be cleaned, for examples, a carpet, a floor, a wall, and so on so that it is difficult for the user to effectively perform a cleaning task. For solving the problem, suction brushes with various sizes or functions are used like accessory brushes. However, it is inconvenient for the users to use the accessory suction brush because the users separates the conventional suction brush from the extension pipe, and then, connects the accessory suction brush to the extension pipe.

Furthermore, the conventional suction brush including accessory suction brushes have a structure in that the top housing and the bottom housing are coupled with each other using screws. As a result, when the users disassemble the suction brush in order to clean or maintain the suction brush, the users unscrew the suction brush, and then, separate the top housing from the bottom housing so as to feel inconvenient.

Also, after the suction brush is repeatedly unscrewed and screwed many times, screw bosses are worn so that the screws are not tightly fixed to the screw bosses. As a result, the top housing and the bottom housing cannot be stably connected with each other.

SUMMARY OF THE INVENTION

The present disclosure has been developed in order to overcome the above drawbacks and other problems associated with the conventional arrangement. An aspect of the present disclosure is to provide a suction brush for a vacuum cleaner having a structure in that a top housing and a bottom housing thereof can be easily assembled and separated with each other.

Another aspect of the present disclosure is to provide a suction brush for a vacuum cleaner capable of controlling the strength of a suction force applied to the suction brush. The above aspect and/or other feature of the present disclosure can substantially be achieved by providing a suction brush for a vacuum cleaner, which is connected to an suction extension pipe connected to a main body of the vacuum cleaner and draws in foreign materials using a suction force generated in the main body. The suction brush includes a bottom housing with a dust entering port; a top housing connected to the bottom housing so as to cover the bottom housing; a connector disposed between the top housing and the bottom housing, the connector connected to the suction extension pipe; and a flow rate controller disposed at the connector, the flow rate controller controlling a volume of the air entering through the dust entering port so as to control a suction force.

Here, the flow rate controller comprises: a plurality of fine holes formed at the connector; and a holder partially wrapping around the connector, the holder selectively opening or closing the plurality of fine holes according to positional changes of the holder.

Furthermore, the holder has a substantially ring shape with a cut portion, and is elastically adhered to an outer circumferential surface of the connector, wherein the holder can be rotated along the outer circumferential surface of the connector by an external force.

Also, preferably the suction brush further comprises a turbine and a brush drum disposed between the top and bottom housings. The turbine is rotated by the flow of the air entering through the dust entering port, and the brush drum is rotated by the turbine and has a brush sweeping foreign materials from the surface to be cleaned.

Furthermore, the connector comprises: a first connector part formed integrally with the bottom housing; and a second connector part formed integrally with the top housing and connected to the first connector part so as to form a substantially pipe shape.

Also, the first connector part comprises a cylindrical pipe portion at an end of the first connector part.

Furthermore, the connector comprises: a first connector part formed integrally with the bottom housing; and a second connector part formed integrally with the top housing and connected to the first connector part so as to form a substantially pipe shape, wherein the first and second connector parts are wrapped around by the holder so as to be connected to each other.

Also, the connector further preferably comprises a guiding rib projecting along an outer circumferential surface of the connector and guiding the holder to rotate.

According to another aspect of the present disclosure, a suction brush for a vacuum cleaner, which is connected to an suction extension pipe connected to a main body of the vacuum cleaner and draws in foreign materials using a suction force generated in the main body, includes a bottom housing with a dust entering port; a top housing connected to the bottom housing so as to cover the bottom housing; a connector comprising a first connector part formed integrally with the bottom housing and a second connector part formed integrally with the top housing, the connector connected to the suction extension pipe; and a holder elastically wrapping around the first and second connector parts so as to couple the first connector part and the second connector part.

Here, each of the top and bottom housings comprises a coupling portion formed integrally at a leading end of each thereof, and the coupling portions of the top and bottom housings are connected to each other. Rear ends of the top and bottom housings are coupled by the holder wrapped around the first and second connector parts.

Furthermore, at least one of the first and second connector parts comprises a plurality of fine holes, the opened extent of which is set by a positional change of the holder, so that the holder is able to control the suction force applied to the dust entering port.

Also, the holder is formed in a substantially ring shape with a cut portion so as to elastically deform and restore.

Furthermore, the suction brush further comprises a turbine and a brush drum disposed between the top and bottom housings. The turbine is rotated by the flow of the air entering through the dust entering port. The brush drum is disposed at the dust entering port so as to be rotated by the turbine, and has a brush on an outer circumferential surface of the brush drum.

Also, the holder comprises an undulated surface at an outer circumferential surface of the holder.

Also, the connector comprises a guiding rib projecting along an outer circumferential surface of the connector and guiding the holder to rotate.

Other objects, advantages and salient features of the disclosure will become apparent from the following detailed description, which, taken in conjunction with the annexed drawings, discloses preferred embodiments of the disclosure.

BRIEF DESCRIPTION OF THE DRAWINGS

These and/or other aspects and advantages of the disclosure will become apparent and more readily appreciated from the following description of the embodiments, taken in conjunction with the accompanying drawings of which.

Throughout the drawings, like reference numerals will be understood to refer to like parts, components and structures.

DETAILED DESCRIPTION OF THE EXEMPLARY EMBODIMENTS

Hereinafter, certain exemplary embodiments of the present disclosure will be described in detail with reference to the accompanying drawings.

The matters defined in the description, such as a detailed construction and elements thereof, are provided to assist in a comprehensive understanding of the disclosure. Thus, it is apparent that the present disclosure may be carried out without those defined matters. Also, well-known functions or constructions are omitted to provide a clear and concise description of exemplary embodiments of the present disclosure.

Figure 1:
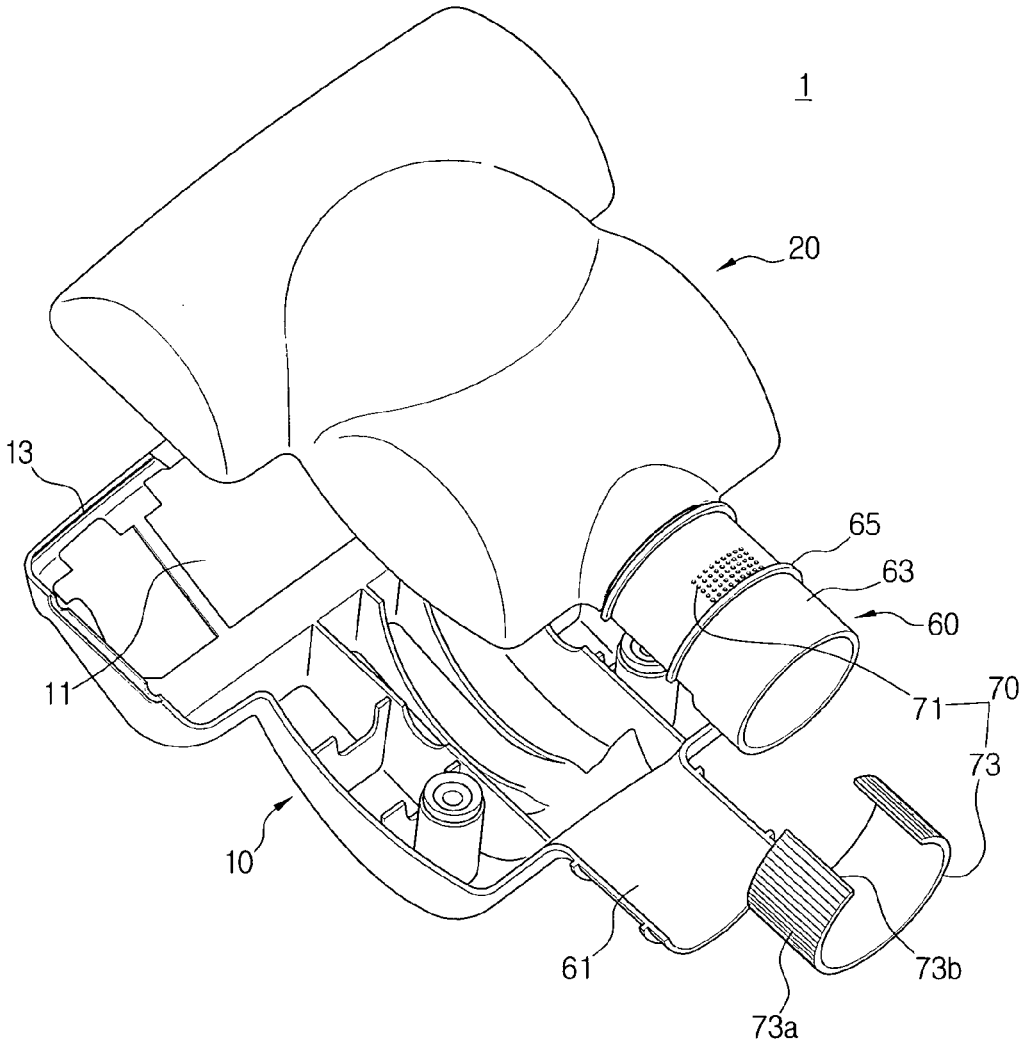
FIG. 1 is an exploded perspective view illustrating a suction brush for a vacuum cleaner according to an embodiment of the present disclosure.

FIG. 1 is an exploded perspective view illustrating a suction brush for a vacuum cleaner according to an embodiment of the present disclosure.

Figure 2:
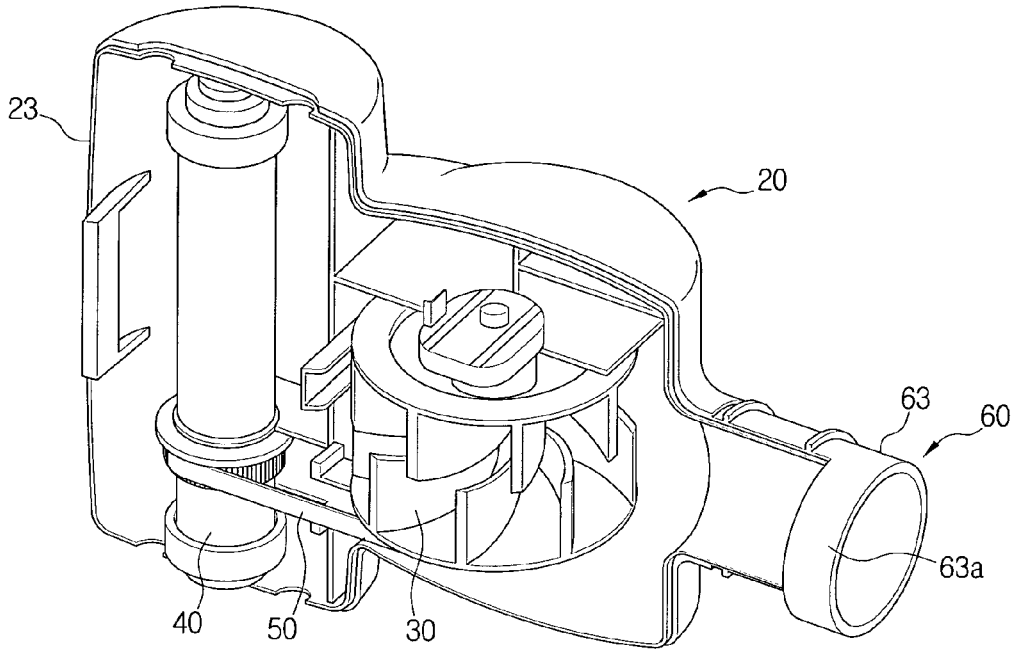
FIG. 2 is a bottom perspective view illustrating a top housing of FIG. 1.
Figure 3:
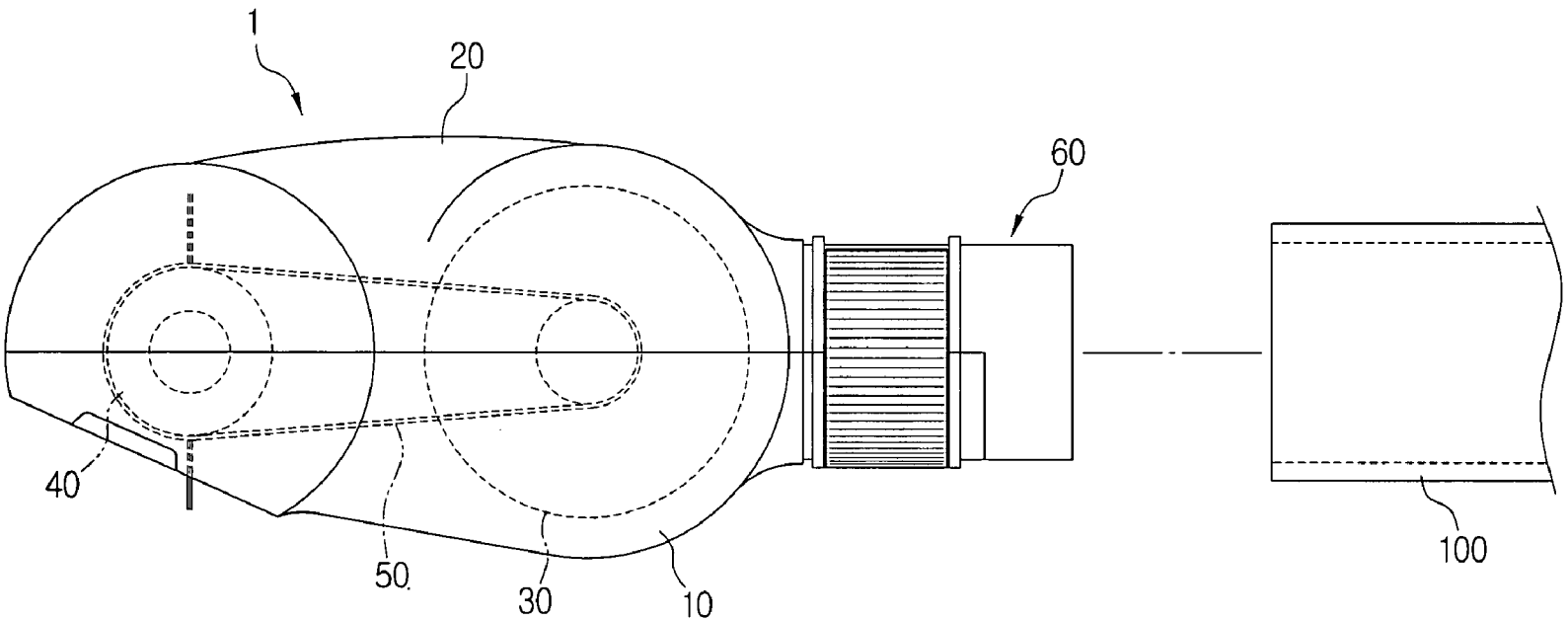
FIG. 3 is a side view illustrating a suction brush for a vacuum cleaner according to an embodiment of the present disclosure.

Referring to FIG. 1, a suction brush 1 can be selectively connected to or separated from an suction extension pipe, where the suction extension pipe is connected to a main body (not shown) of a vacuum cleaner so that users can connect the suction brush to the suction extension pipe as desired. The vacuum cleaner is provided with a driving motor generating a suction force and a dust collecting apparatus collecting foreign material entering through the suction brush 1. The dust collecting apparatus can comprise a dust bag, a cyclone dust collecting unit, and so on. The suction extension pipe is connected to the main body via a flexible connecting hose. The suction extension pipe may have a handle with a controlling switch to turn on and off the driving motor. The suction brush 1 includes a bottom housing 10 and a top housing 20, which is connected to the bottom housing 10 and covers the bottom housing 10. As shown in FIGS. 2 and 3, a turbine 30 and a brush drum 40 are disposed inside the top and bottom housings 10 and 20. The bottom housing 10 has a dust entering port 11 for drawing-in foreign material from a surface to be cleaned by the suction force. The brush drum 40 is partially exposed through the dust entering port 11. The exposed part of the brush drum 40 hits or scrapes the surface to be cleaned so as to separate the foreign material attached on the surface to be cleaned therefrom so that the separated foreign material is drawn-in into the suction brush 1.

The top housing 20 is formed in a shape corresponding to the bottom housing 10.

The turbine 30 is rotatably disposed between the top and bottom housings 10 and 20. The turbine 30 is rotated by the flow of the air entering through the dust entering port 11.

The brush drum 40 is connected to the turbine 30 via a power transmitting means 50 such as a power transmitting belt. As a result, the brush drum 40 receives the power of the turbine 30 so as to rotate. The brush drum 40 is formed in a substantially drum shape so that a plurality of brushes with a predetermined length are disposed at an outer circumferential surface of the brush drum 40 in a spiral shape. The brush drum 40 has also a belt connecting portion to which the power transmitting belt 50 is connected.

Figure 4:
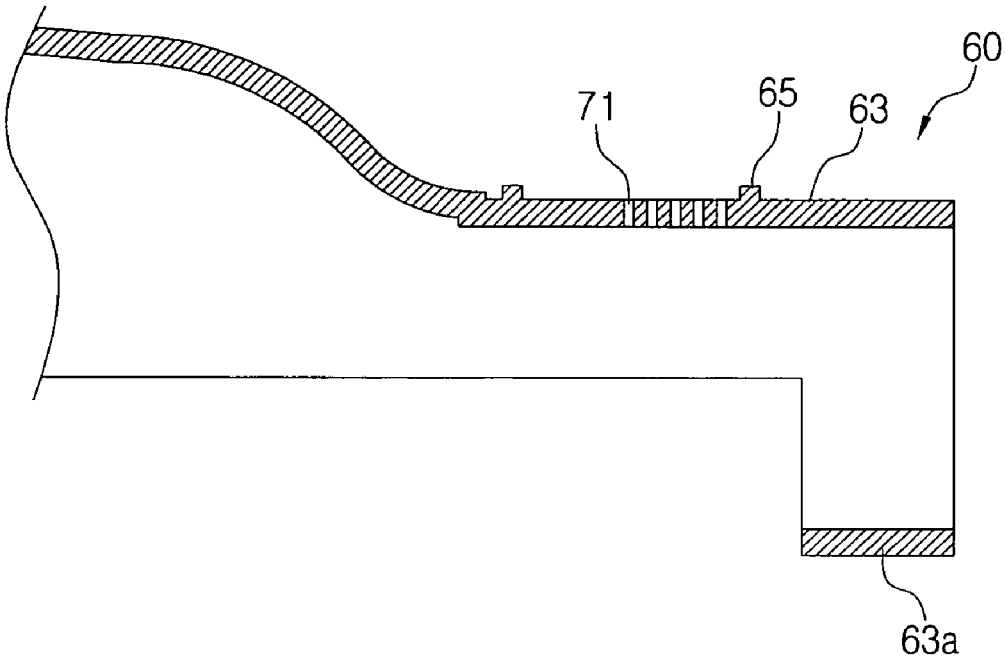
FIG. 4 is a partial sectional view illustrating a second connector part of FIG. 1.

Furthermore, the suction brush 1 according to an embodiment of the present disclosure includes a connector 60 for connecting the suction brush 1 to the suction extension pipe 100. The connector 60 includes a first connector part 61 integrally formed with the bottom housing 10, and a second connector part 63 integrally formed with the top housing 20. The first and second connector parts 61 and 63 are coupled to face each other so as to form a substantially pipe shape. The second connector part 63 has a pipe portion **63*a* having a substantially cylindrical shape at an end thereof as shown in FIG. 4. The remaining portion of the second connector part 63 except the pipe portion 63*a*** is formed in a substantially semicircular pipe shape, namely, in a longitudinally cut pipe shape.

The first and second connector parts 61 and 63 are elastically adhered to couple to each other by a holder 73 as described below. In other words, in the suction brush 1 according to an embodiment of the present disclosure, the bottom housing 10 has a first coupling portion 13 at a leading side of the bottom housing 10 (at a direction where the dust entering port 11 is formed), and the top housing 20 has a second coupling portion 23 at a leading side of the top housing 20 (at a direction where the dust entering port 11 is formed). The first and second coupling portions 13 and 23 are formed to connect to each other. Therefore, the first and second coupling portions 13 and 23 are inserted, adhered, or locked each other so that the leading sides of the bottom and top housings 10 and 20 are coupled each other. For this end, each of the first and second coupling portions 13 and 23 is formed integrally with each of the bottom and top housings 10 and 20, and may have any of well known various structures, for an example, a locking protrusion and a locking groove. A rear side of each of the bottom and top housings 10 and 20 are closely coupled each other by the holder 73 as described above. In this embodiment, the rear sides of the bottom and top housings 10 and 20 may be understood as the connector 60.

As described above, the bottom and top housings 10 and 20 are coupled without using separate fixing members such as screws. Therefore, it is easier to assemble and disassemble the suction brush 1 according to the present disclosure than to assemble and disassemble the conventional suction brush. Also, a number of parts for coupling the suction brush 1 according to the present disclosure may be decreased. Furthermore, because it can prevent the connection of the bottom and top housings 10 and 20 from loosing, the suction brush 1 according to the present disclosure can maintain the reliability thereof for a long time. Repeatedly assembling and disassembling the bottom and top housings 10 and 20 using the fixing members such as screws causes screw bosses of the bottom and top housings 10 and 20 to be worn so that the connection of the bottom and top housings 10 and 20 is loosened.

Furthermore, the suction brush 1 according to an embodiment of the present disclosure includes a flow rate controller 70 for controlling a volume of the air entering through the dust entering port 11. The flow rate controller 70 controls the volume of the air entering through the dust entering port 11 so as to control a rotation speed of the turbine 30. As a result, the flow rate controller 70 can control the rotation speed of the brush drum 40. The flow rate controller 70 includes a plurality of fine holes 71 formed at the connector 60, in detail, in the second connector part 63, and the holder 73 movably disposed at the connector 60 so as to control the opened extent of the plurality of fine holes 71.

Each of the plurality of fine holes 71 has a small diameter, preferably a range of the diameter of approximately 1-5 mm, and is formed closely together. Because the fine holes 71 are formed at the downstream of the turbine 30 on the basis of the flowing direction of the air, the fine holes 71 are not clogged by foreign material such as hair, thread, and so on so that the flow rate controller 70 can control the volume of the air entering the turbine 30. On the other hand, in this embodiment, the fine holes 71 are formed at the second connector part 63; however this is described as only one example. In fact, the fine holes 71 may be formed at the first connector part 61, or at both the first and second connector parts 61 and 63 so as to perform the same function.

The holder 73 is formed in a substantially ring shape with a cut portion 73*b* as shown in FIG. 1, and can be deformed and elastically restored according as an external force is applied and removed. The cut portion 73*b* of the holder 73 is a portion in that the holder 73 is partially cut in the circumferential direction of the holder 73. Users spread the cut portion 73*b* of the holder 73, and then, put the holder 73 to wrap around the connector 60 so that the holder 73 elastically restores to adhere closely to the outer circumferential surface of the connector 60 and presses the connector 60. As a result, the connection of the first and second connector parts 61 and 63 is maintained by the force of the holder 73 pressing the connector 60. For this end, before the holder 73 is connected to the connector 60, namely, when the external force is not applied to the holder 73, preferably, the diameter of the holder 73 is smaller than the diameter of the connector 60. The holder 73 may be made of any of a plastic material and a metallic material.

Furthermore, preferably the holder 73 has, at the outer circumferential surface thereof, an undulated surface 73*a* so as to increase the friction force of the holder 73. As a result, the holder 73 prevents the users' hand from sliding on the holder 73 when the users rotate the holder 73.

The holder 73 coupled to the connector 60 can rotate along the outer circumferential surface of the connector 60 so as to control the opened extent of the plurality of fine holes 71. Preferably, the holder 73 is disposed at the connector 60 so as to cover the plurality of fine holes 71, and is prevented from moving in a longitudinal direction of the connector 60. For this end, a guiding rib 65 preferably projects along the outer circumferential surface of the connector 60. The holder 73 rotates with respect to the connector 60 while being guided by the guiding rib 65 so as to completely open, completely close, or partially open the plurality of fine holes 71.

Figure 5:
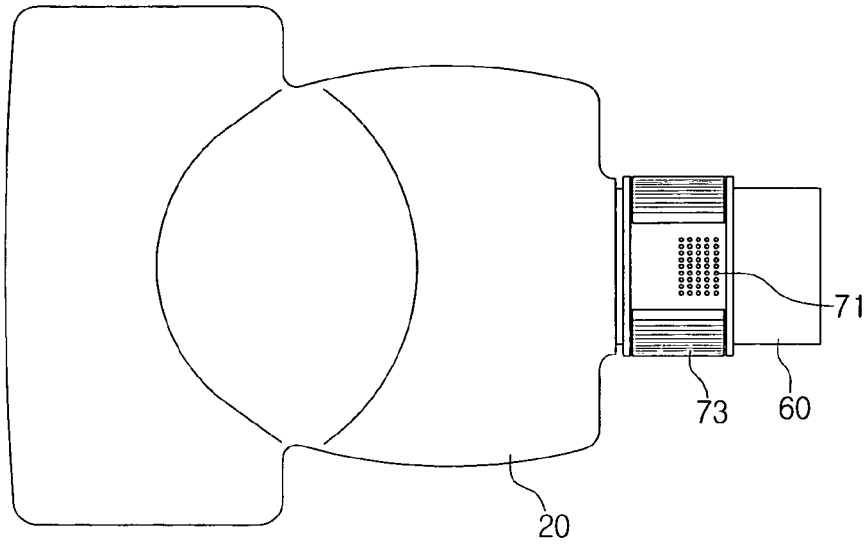
FIGS. 5 and 6 are plan views illustrating the operation of a holder disposed at a connector of FIG. 1, respectively.

In other words, as shown in FIG. 5, when the cut portion 73*b* of the holder 73 is located in a place corresponding to the fine holes 71, the plurality of fine holes 71 is completely open. When the entire fine hole 71 is open, the volume of the air entering the turbine 30 through the dust entering port 11 is minimized. At this time, the rotation power and the rotation speed of the turbine 30 is decreased to a minimum. As a result, the rotation speed of the brush drum 40 can be controlled to decrease to a minimum.

Figure 6:
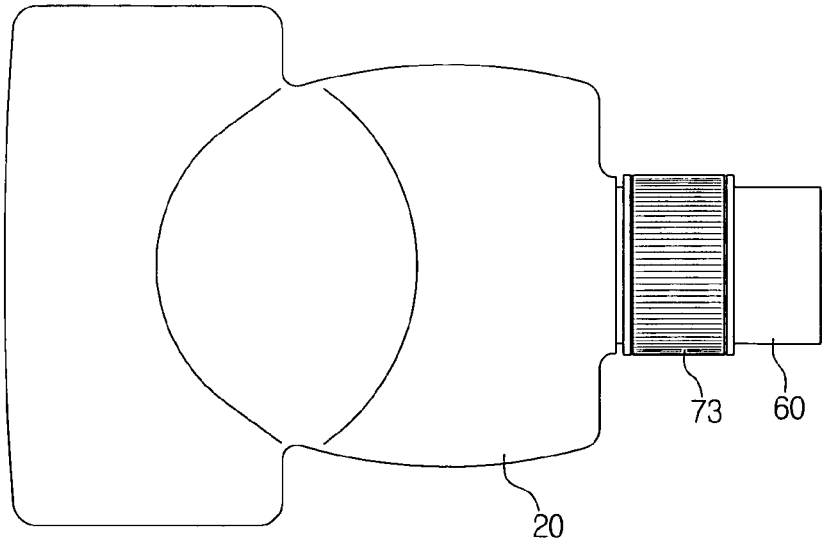

On the contrary, as shown in FIG. 6, the holder 73 is rotated to close the entire fine holes 71. At this time, the suction force is entirely concentrated at the dust entering port 11 so that the volume of the air entering the turbine 30 is maximized. As a result, the rotation power and the rotation speed of each of the turbine 30 and the brush drum 40 can be controlled to increase to a maximum.

In the suction brush 1 according to the present disclosure, users control the opened extent of the fine holes 71 so as to control the rotation power and the rotation speed of each of the turbine 30 and the brush drum 40. As a result, the suction brush 1 according to the present disclosure can perform the cleaning work using appropriate suction force and brushing force corresponding to shapes and kinds of surfaces to be cleaned.

With the suction brush for a vacuum cleaner according to the present disclosure, because the connector is formed integrally with the housing of the suction brush, and coupled by the holder, it is not required to use fixing members such as screws. As a result, assembling and disassembling of the suction brush are easier than those of the conventional suction brush.

Furthermore, the holder for coupling the connector can be used to control the opened extent of the plurality of fine holes so as to control the volume of the air being draw-in into the dust entering port by the suction force. As a result, the rotation power and the rotation speed of the turbine, which is rotated by the entering air, is controlled so that the rotation speed and the brushing power of the brush drum can be controlled according to various surfaces to be cleaned.

Especially, because the plurality of fine holes for controlling the volume of the air is formed at the downstream of the turbine, foreign materials such as hair, thread, and so on are prevented from clogging the fine holes.

While the embodiments of the present disclosure have been described, additional variations and modifications of the embodiments may occur to those skilled in the art once they learn of the basic inventive concepts. Therefore, it is intended that the appended claims shall be construed to include both the above embodiments and all such variations and modifications that fall within the spirit and scope of the disclosure.

What is claimed is:

1. A suction brush for a vacuum cleaner, which is connectable to a suction extension pipe connected to a main body of the vacuum cleaner and can draw in foreign materials using a suction force generated in the main body, the suction brush comprising:

a bottom housing with a dust entering port;

a top housing connected to the bottom housing so as to cover the bottom housing;

a connector comprising a first connector part which is formed integrally with the bottom housing and a second connector part which is formed integrally with the top housing to be connected to the first connector part so as to form a pipe shape, the connector being connectable to the suction extension pipe; and a flow rate controller disposed at the connector, the flow rate controller controlling a volume of the air entering through the dust entering port so as to control the suction force transmittable to the dust entering port, wherein the flow rate controller comprises:

a plurality of fine holes formed at the connector; and a holder partially wrapping around the first and the second connector parts and connecting the parts, the holder elastically adhering to an outer circumferential surface of the connector in order to selectively open or close the plurality of fine holes according to positional changes of the holder.

2. The suction brush of claim 1, wherein the holder has a substantially ring shape with a cut portion, and can be rotated along the outer circumferential surface of the connector by an external force.

3. The suction brush of claim 1, further comprising:

a turbine and a brush drum disposed between the top and bottom housings, the turbine being rotatable by a flow of the air entering through the dust entering port, the brush drum being rotated by the turbine and having a brush for sweeping foreign materials from the surface to be cleaned.

4. The suction brush of claim 1, wherein the first connector part comprises a cylindrical pipe portion at an end of the first connector part.

5. The suction brush of claim 1, wherein the connector further comprises a guiding rib projecting along an outer circumferential surface of the connector and guiding the holder to rotate.

6. The suction brush of claim 1, wherein each of the top and bottom housings comprises a coupling portion formed integrally at a leading end of each thereof, and the coupling portions of the top and bottom housings are connected to each other, wherein rear ends of the top and bottom housings are coupled by the holder wrapped around the first and second connector parts.

7. The suction brush of claim 1, wherein the plurality of fine holes is formed on at least one of the first and second connector parts.

8. The suction brush of claim 1, wherein the holder is formed in a substantially ring shape with a cut portion so as to elastically deform and restore.

9. The suction brush of claim 1, wherein the holder comprises an undulated surface at an outer circumferential surface of the holder.

* * * * *